US006939422B2

(12) United States Patent
Moulin et al.

(10) Patent No.: US 6,939,422 B2
(45) **Date of Patent: *Sep. 6, 2005**

(54) METHOD FOR BUILDING SHEET PILE WALLS

(75) Inventors: Jean-Michel Moulin, Saint-Julien-lès-Metz (FR); André Rix, Messancy (BE)

(73) Assignee: Arcelor Rails, Piles & Special Sections, Esch-sur-Alzette (LU)

( * ) Notice: Subject to any disclaimer, the term of this patent is extended or adjusted under 35 U.S.C. 154(b) by 0 days.

This patent is subject to a terminal disclaimer.

(21) Appl. No.: 10/240,030

(22) PCT Filed: Mar. 22, 2001

(86) PCT No.: PCT/EP01/03249

§ 371 (c)(1),
(2), (4) Date: Sep. 26, 2002

(87) PCT Pub. No.: WO01/73211

PCT Pub. Date: Oct. 4, 2001

(65) Prior Publication Data

US 2003/0047267 A1 Mar. 13, 2003

(30) Foreign Application Priority Data

Mar. 29, 2000 (LU) ..... 90559

(51) Int. Cl.[7] ..... E04B 1/08; E04B 1/18; E04B 2/72; B29C 65/52; B29C 65/56

(52) U.S. Cl. ..... 156/71; 156/304.2; 156/304.5; 52/79.9; 52/579; 52/581; 52/745.05; 52/745.1; 52/745.13; 52/745.21; 52/746.1

(58) Field of Search ..... 156/71, 156, 303.1, 156/304.1–304.3, 304.5; 52/3–5, 79.1, 79.3, 79.9, 415, 416, 579, 581, 588.1, 745.05, 745.09, 745.1, 745.13, 745.14, 745.21, 746.1

(56) References Cited

U.S. PATENT DOCUMENTS 5,547,318 A * 8/1996 Decker ..... 405/303

FOREIGN PATENT DOCUMENTS

| | | |
|---|---|---|
| BE | 1006600 A | 10/1994 |
| DE | 2722978 | 11/1978 |
| EP | 0628662 A | 12/1994 |
| GB | 2322658 A | 9/1998 |
| JP | 01207520 | 8/1989 |
| NL | 8602762 A | 5/1988 |

* cited by examiner

*Primary Examiner*—Chris Fiorilla
*Assistant Examiner*—Sing P. Chan
(74) *Attorney, Agent, or Firm*—McCormick, Paulding & Huber LLP

(57) ABSTRACT

A method for building a sheet pile wall includes providing a first sheet pile having a leading sheet pile interlock with an interlock chamber, driving the first sheet pile into the ground while protecting the interlock chamber from ground material and providing a second sheet pile having a trailing sheet pile interlock with an interlock head. The method further includes coating a fixing agent as a surface layer on the interlock head of the trailing sheet pile interlock, engaging the coated interlock head of the trailing sheet pile interlock in the interlock chamber of the leading sheet pile interlock and driving the second sheet pile into the ground so that the trailing sheet pile interlock interlocks with the leading sheet pile interlock.

10 Claims, 5 Drawing Sheets

METHOD FOR BUILDING SHEET PILE WALLS

FIELD OF THE INVENTION

The present invention relates to a method for building sheet pile walls.

BACKGROUND OF THE INVENTION

The use of sheet piles for building retaining walls is well known. The sheet piles used in such walls have sheet pile interlocks along their longitudinal edges, which can be interlocked so as to maintain the longitudinal edges of adjacent sheet piles interconnected with each other. Current sheet pile interlocks of the double-hook interlock type (type 1 according to EN10248 norm), as e.g. LARSSEN type sheet pile interlocks, are hook shaped elements with an internal interlock chamber. A sheet pile wall is formed by driving a first sheet pile into the ground, introducing the bottom end of the trailing sheet pile interlock of a second sheet pile with the top end of the leading sheet pile interlock of the first sheet pile, driving the second sheet pile into the ground, and then repeating the process to insert third, fourth etc sheet piles into the wall.

It is often necessary to secure two interconnected sheet pile interlocks against longitudinal shifting relative to one another. This can be achieved by bonding the interlocked sheet pile interlocks with a fixing agent, like e.g. an adhesive or cement.

U.S. Pat. No. 4,981,540 discloses a method for securing sheet pile interlocks, wherein the interlock chamber of the leading sheet pile interlock is filled with an adhesive, and a caliber piece is applied to the interlock to protect the adhesive and keep soil out of the interlock chamber. Once the sheet pile is driven in, the caliber piece is extracted and a next sheet pile can be driven in. The trailing sheet pile interlock of the next sheet pile is forced into the adhesive filling the interlock chamber in the leading sheet pile interlock of the sheet pile in place in the ground. A major drawback of this method is that the adhesive in the interlock chamber will make the withdrawal of the caliber piece more difficult. Furthermore, an adhesive with a long curing time must be used, as the adhesive must not be allowed to set until the next sheet pile is driven into the ground. According to another method described in U.S. Pat. No. 4,981,540, a caliber piece, having a pipe with nozzles mounted on it, is introduced into the leading sheet pile interlock before the sheet pile is driven in. Once the ramming operation is finished, the caliber piece is withdrawn while an adhesive is simultaneously injected through the pipe nozzles into the interlock chamber. A major drawback of this second method is that a very fluid adhesive must be used, because it has to be injected through a long pipe into the interlock chamber. It is however impossible to warrant a homogeneous distribution of such a fluid adhesive in a vertical interlock chamber, which is subjected to impacts and vibrations during the ramming process of the next sheet pile. In order ensure good bond conditions, it is with both methods important to keep ground material off the contact surfaces of the interlocking sheet pile interlocks. However, when the caliber piece is withdrawn, ground material inevitably mixes with the uncured adhesive, thereby impairing the bond conditions. A further drawback of the above methods is that the interlock head of the trailing sheet pile interlock engaging the interlock chamber of the leading sheet pile interlock progressively acts upon the adhesive in the interlock chamber as a kind of percussive expulsion piston pushing most of the adhesive out of the interlock chamber. In other words, most of the adhesive injected into the interlock chamber is lost in the surrounding ground.

For the sake of completeness it will be mentioned that following prior art documents disclose methods for providing a seal between two interlocked sheet pile locks:

DE 2722978 teaches more particularly to inject a sealing mass in the interlock chamber of a sheet pile and to form by means of a stripping device a shaped seal that is firmly bonded to an internal surface of the interlock chamber. Once the sealing mass has hardened to form an elastic seal in the interlock chamber, the sheet pile is driven into the ground, wherein an interlocking head of a sheet pile previously driven into the ground engages the interlock chamber having the seal therein.

EP 0628662 teaches more particularly to inject a sealing mass in a special sealing chamber defined between two sheet pile interlocks.

BE 1006600 teaches more particularly to fill a sealing mass in an interlock chamber of a sheet pile, wherein a specially shaped mandrel is used to distribute and shape the sealing mass on the internal surfaces of the interlock chambers. Thereafter, the first sheet pile is interlocked with a second sheet pile, and both sheet piles are then jointly driven into the ground.

GB 2322658 teaches more particularly to fill the interlock chamber of a sheet pile, which is already driven into the ground, with a hardening sealant. It suggests using an injection conduit, which is retractably inserted in the interlock chamber and driven into the ground at the same time as the sheet pile. Once this sheet pile is in position, the sealant is pumped through the injection conduit into the interlock chamber, while the injection conduit is simultaneously drawn upwards out of the interlock chamber. Once the injection conduit has been entirely removed from the interlock chamber, a second sheet pile can be driven into the ground in an interlocking relationship with the first sheet pile.

JP 01-207520 teaches to fill the interlock chambers of a first sheet pile and of a second sheet pile with a foaming resin prior to driving them into the ground. Once the foaming resin is hardened in the interlock chambers, the sheet piles can be driven in sequence into the ground, wherein the hardened foaming resin should prevent the infiltration of sediment into a joint section, facilitate the driving and prevent the deformation and damage of the sheet piles.

SUMMARY OF THE INVENTION

The technical problem underlying the present invention is to provide an improved method for building a sheet pile wall, which alleviates or remedies the above drawbacks when using a fixing agent for securing two sheet piles. This problem is solved by a method as claimed in claim 1.

In accordance with the method of the present invention, a first and a second sheet pile are provided, the first sheet pile having a leading sheet pile interlock with an interlock chamber, the second sheet pile having a trailing sheet pile interlock with an interlock head. The first sheet pile is driven into the ground while protecting the interlock chamber from ground material. The interlock head of the trailing sheet pile interlock is engaged in the interlock chamber of the leading sheet pile interlock before the second sheet pile is driven into the ground. An important feature of the method is that prior to engaging the interlock head of the trailing sheet pile interlock in the interlock chamber of the leading sheet pile interlock, the interlock head of the trailing sheet pile interlock is coated with a fixing agent. While driving the first sheet pile into the ground, the interlock chamber of its leading sheet pile interlock is protected from ground material. It follows that when the second sheet pile is interconnected, the coated interlock head of its trailing sheet pile interlock engages in a clean interlock chamber. As the contact surface of the interlock chamber which receives the interlock head is free from ground material, excellent bond conditions are guaranteed. The method according to the present invention hence allows driving sheet piles into the ground wherein the sheet piles are reliably secured against longitudinal shifting relative to one another. The withdrawal of the protection means is made easier, as no fixing means is present in the interlock chamber of the leading sheet pile interlock when the sheet pile is driven into the ground. The withdrawal of the protection means does furthermore not cause ground material to mix with the fixing means, as no fixing means is present in the interlock chamber of the leading sheet pile interlock as the sheet pile is driven into the ground. As the interlock head of the trailing sheet pile interlock can be coated with fixing means just before engaging the interlock chamber of the leading sheet pile interlock of the previous sheet pile, it is now possible to use fixing means with a shorter curing time. It is furthermore possible to guarantee a homogenous distribution of the fixing means on the interlock head by using very viscous fixing means which remain on the interlock head. Finally, the interlock head does no longer act as a percussive expulsion piston, therefore no or little fixing means is lost in the surrounding ground.

A spreader can be used for applying the fixing agent onto the interlock head of the trailing sheet pile interlock. The spreader preferably has a spreader chamber that has substantially the same form as the interlock head of a sheet pile interlock, but is slightly bigger than the latter, so that a uniform layer of fixing agent is applied over the whole length of the interlock head of the trailing sheet pile interlock. The fixing agent can be injected into said spreader chamber through an injection opening arranged in said spreader by means of an injection nozzle. As the spreader is moved along the sheet pile interlock, a uniformly thick layer of fixing agent is applied onto the interlock head of the sheet pile interlock.

In accordance with a preferred embodiment of the present invention an obturating device comprising an inflatable tube is inserted into the interlock chamber to be protected. Once the obturating device is in place within the interlock chamber, its inflatable tube is inflated, so that the obturating device effectively closes the opening to the interlock chamber. It follows that no ground material can enter the interlock chamber while the sheet pile is being driven into the ground. Once the sheet pile is in place, the inflatable tube is again deflated, and the obturating device can be easily withdrawn from the interlock chamber. In short, while the inflatable tube is inflated, the obturating device ensures excellent protection for the interlock chamber against ground material, and while the inflatable tube is deflated, the obturating device can be easily inserted into or retracted from the interlock chamber.

The obturating device can further comprise a flexible tube with an open front end alongside the inflatable tube which has a closed front end. This flexible tube can then be used for filling the interlock chamber with sand or synthetic foam (as e.g. a PU foam) while the obturating device is withdrawn from the interlock chamber. Especially in case the sheet piles are driven into light or muddy ground material, it is advantageous to fill the interlock chamber with sand or synthetic foam material in order to prevent light or muddy ground material to enter the interlock chamber once the obturating device has been withdrawn. It is not excluded to conceive the flexible tube as a separate piece, but it is preferred to firmly attach it to the inflatable tube and, in particular, to form it in one piece with the inflatable tube.

In accordance with a preferred embodiment, inflation of the inflatable tube pushes an obturating block into the longitudinal opening of the interlock chamber. This obturating block closes the longitudinal opening of the interlock chamber. It will be appreciated that the obturating block can be made stronger than the inflatable tube and is hence less likely to be damaged during the driving process. It is preferably a semi-rigid body, because such a semi-rigid body may be more easily introduced in and withdrawn from the interlock chamber. Furthermore, it is preferably a wedge shaped body engaging the longitudinal opening of the interlock chamber. The wedge shape ensures that, when the inflatable tube is inflated, the obturating block centres itself in the longitudinal opening of the interlock chamber so as to effectively obturate this opening from the inside of the interlock chamber. It is not excluded to conceive the obturating block as a separate piece, but it is preferred to firmly attach it to the inflatable tube and, in particular, to form it in one piece with the inflatable tube. The fact that the inflatable tube and obturating block are firmly attached together allows for easy manipulation on the building site.

In particular, when constructing a sheet pile wall, the obturating device is inserted into the interlock chamber of the leading sheet pile interlock of a first sheet pile. The inflatable tube is inflated, e.g. by means of compressed air, and this first sheet pile is driven into the ground. Once this first sheet pile is in place, the inflatable tube is deflated and the obturating device is withdrawn from the interlock chamber. It will be appreciated that the withdrawn obturating device leaves an interlock chamber in the leading sheet pile interlock that is perfectly clean, i.e. free from any ground material. The obturating device is then inserted into the interlock chamber of the leading sheet pile interlock of a second sheet pile and the inflatable tube is inflated. The interlock head of the trailing sheet pile interlock of the second sheet pile is coated with fixing agent. The bottom end of the trailing sheet pile interlock of the second sheet pile is now interconnected with the top end of the leading sheet pile interlock of the first sheet pile. As the second sheet pile is driven into the ground, the coated interlock head of its trailing sheet pile interlock slides down through the clean interlock chamber of the leading sheet pile interlock of the first sheet pile. Once the sheet pile is in place, the inflatable tube is again deflated and the obturating device withdrawn. This process is repeated for the third, fourth, etc sheet piles. Consequently, the trailing sheet pile interlock of a sheet pile is always interconnected with a clean leading sheet pile interlock of the preceding sheet pile. It follows that the sheet piles are reliably secured, as excellent bond conditions are guaranteed through the clean contact surfaces in the leading sheet pile interlocks.

Before driving a sheet pile into the ground, it is recommended to insert a front end obturator in the bottom end of the interlock chamber of a leading sheet pile interlock. The front end obturator displaces ground material from under the axial opening of the interlock chamber and prevents ground material from axially entering the interlock chamber. It will be appreciated that the front end obturator can e.g. be a simple bolt. However, in order to be most effective, the front end obturator advantageously has a conical head. The front end obturator is preferably just inserted into the interlock chamber, rather than fixed to the sheet pile, so that the front end obturator can simply be pushed out of the interlock chamber of the leading sheet pile interlock by the trailing sheet pile interlock of the subsequent sheet pile. This is of particular interest in case a sheet pile needs to be driven deeper into the ground than the preceding one.

A short cleaning piece is preferably engaged with the leading sheet pile interlock of a first sheet pile before interconnecting this interlock with the trailing sheet pile interlock of a second sheet pile. When the second sheet pile is driven into the ground, its trailing sheet pile interlock pushes the cleaning piece along the leading sheet pile interlock of the first sheet pile. It will be appreciated that the cleaning piece can e.g. be a piece of an interlocking sheet pile interlock, which removes any ground material from the inner walls of the leading sheet pile interlock and preferably wraps the outer walls of the leading sheet pile interlock, so that it also effectively removes any ground material from the outer walls of the leading sheet pile interlock. It follows that all exterior and interior contact surfaces of the leading sheet pile interlock are free of ground material when coming into contact with the corresponding contact surfaces of the trailing sheet pile interlock of the subsequent sheet pile. Usage of the cleaning piece is particularly of advantage if the interlock chamber of the leading sheet pile interlock of the first sheet pile has been filled with sand as the obturating device was withdrawn from the interlock chamber.

It will further be appreciated that alternative protection means for protecting the interlock chamber from ground material can be considered.

BRIEF DESCRIPTION OF THE DRAWINGS

A preferred embodiment of the present invention will now be described, by way of example, with reference to the accompanying drawings, in which.

DETAILED DESCRIPTION OF A PREFERRED EMBODIMENT

Figure 1:
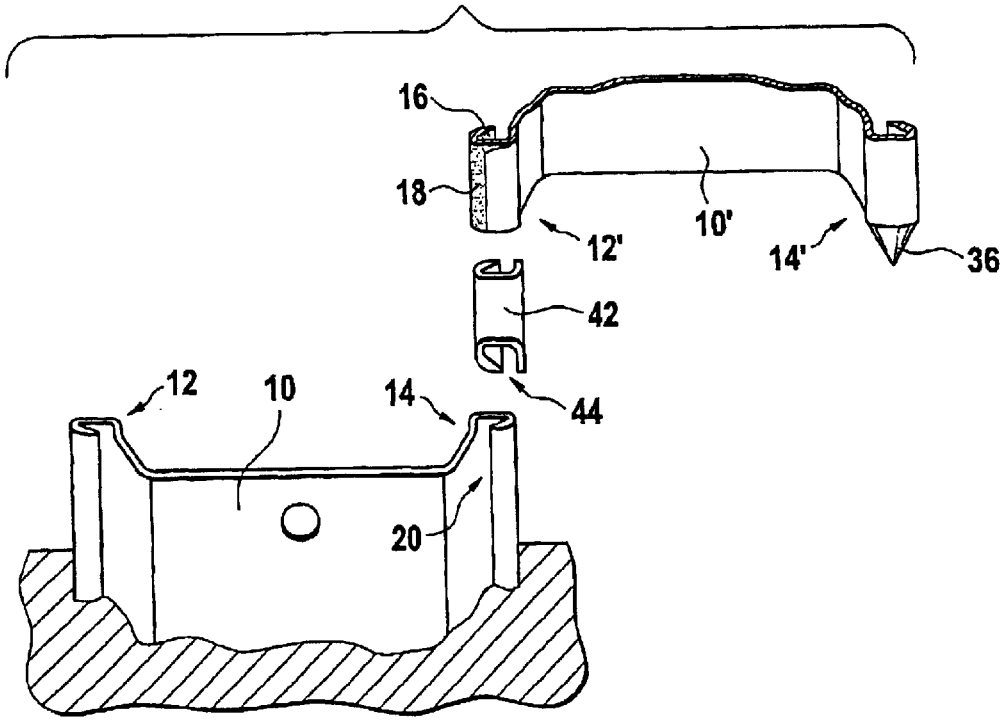
FIG. 1: is a perspective view of two sheet piles being interconnected.

On FIG. 1, a first sheet pile 10 with its trailing and leading sheet pile interlocks 12, 14 can be seen in place in the ground. A second sheet pile 10' with its trailing and leading sheet pile interlocks 12', 14' is ready to be interlocked with the first sheet pile 10. The trailing sheet pile interlock 12' of the second sheet pile 10' has an interlock head 16 coated with a fixing agent 18. This interlock head 16 engages in an interlock chamber 20 of the leading sheet pile interlock 14 of the first sheet pile 10. The interlock chamber 20 is clean, i.e. it is free from any ground material. The interlock head 16 of the trailing sheet pile interlock 12' of the second sheet pile 10' slides down the clean interlock chamber 20 of the leading sheet pile interlock 14 of the first sheet pile 10 as the second sheet pile 10' is driven into the ground.

Figure 2:
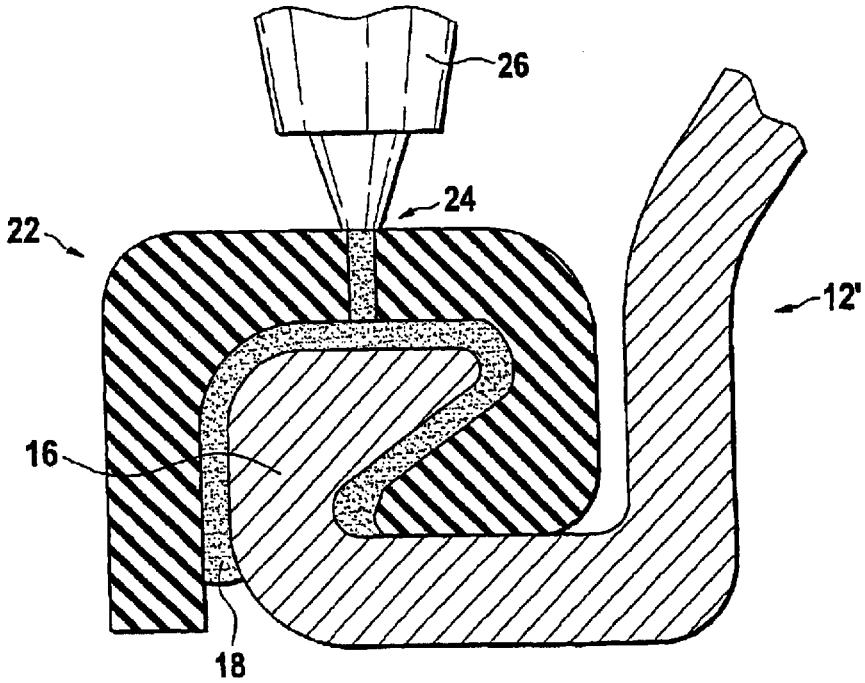
FIG. 2: is a section through a sheet pile interlock on which fixing agent is being applied.

FIG. 2 shows a trailing sheet pile interlock 12' whose interlock head 16 is being coated with a fixing agent 18. The fixing agent 18 is being applied by means of a spreader 22, which has a spreader chamber that has substantially the same form as the interlock head 16 of a sheet pile interlock, but is slightly bigger than the latter, so that a uniform layer of fixing agent 18 can be applied over the whole length of the head 16 of the trailing sheet pile interlock 12'. The fixing agent 18 is injected into the spreader chamber of the spreader 22 through an injection opening 24 by means of an injection nozzle 26.

Figure 3:
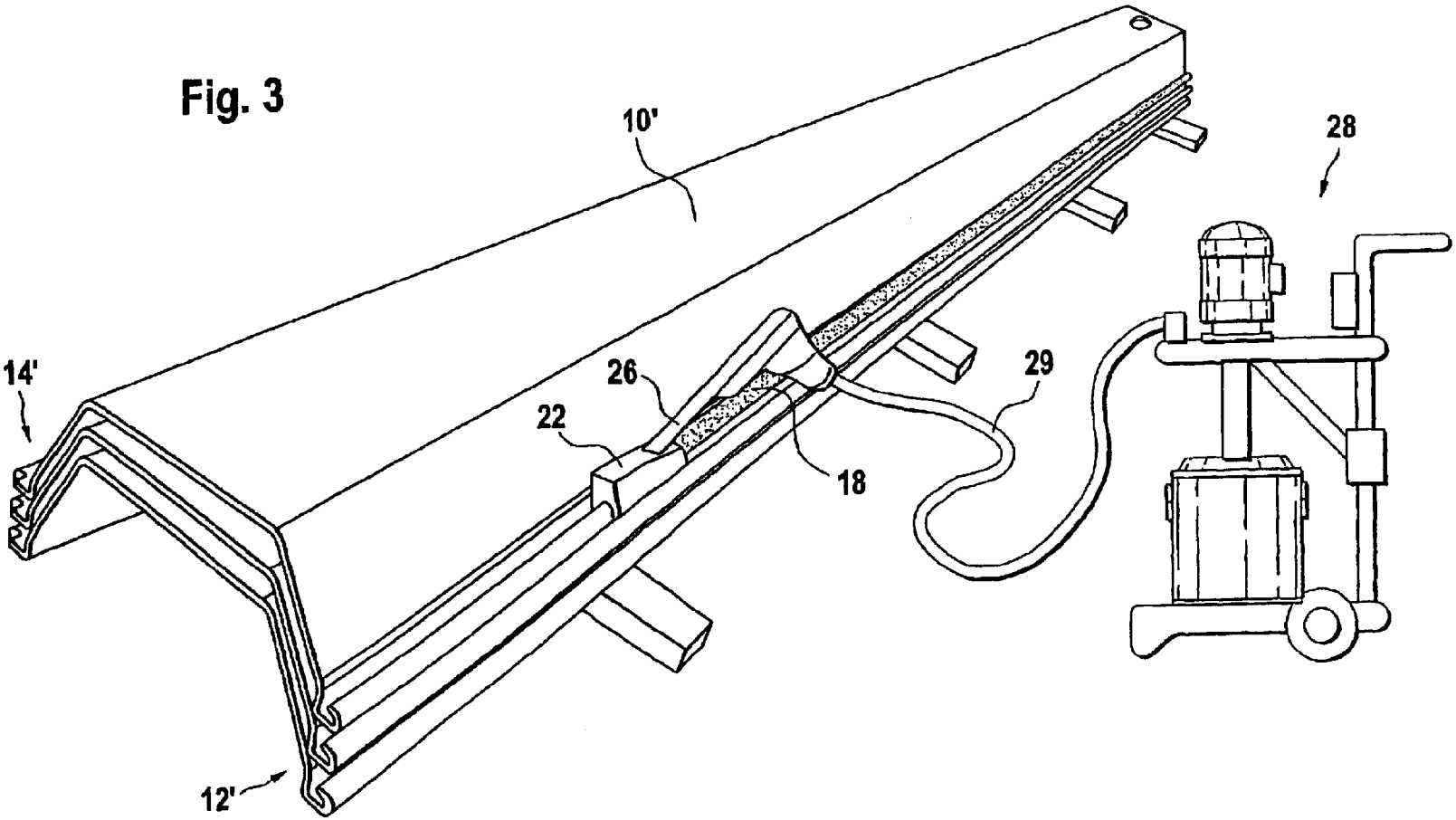
FIG. 3: is a perspective view of a sheet pile on which fixing agent is being applied.

FIG. 3 shows a pumping apparatus 28 for applying a fixing agent 18 onto the trailing sheet pile interlock 12' of a sheet pile 10'. By means of the pumping apparatus 28, and via a flexible tube 29, the injection nozzle 26 injects the fixing agent 18 into the spreader chamber of the spreader 22. As the spreader 22 is moved axially along the trailing sheet pile interlock 12', the interlock head 16 is coated with a uniform layer of fixing agent 18 over the whole length of the sheet pile 10'.

Figure 4:
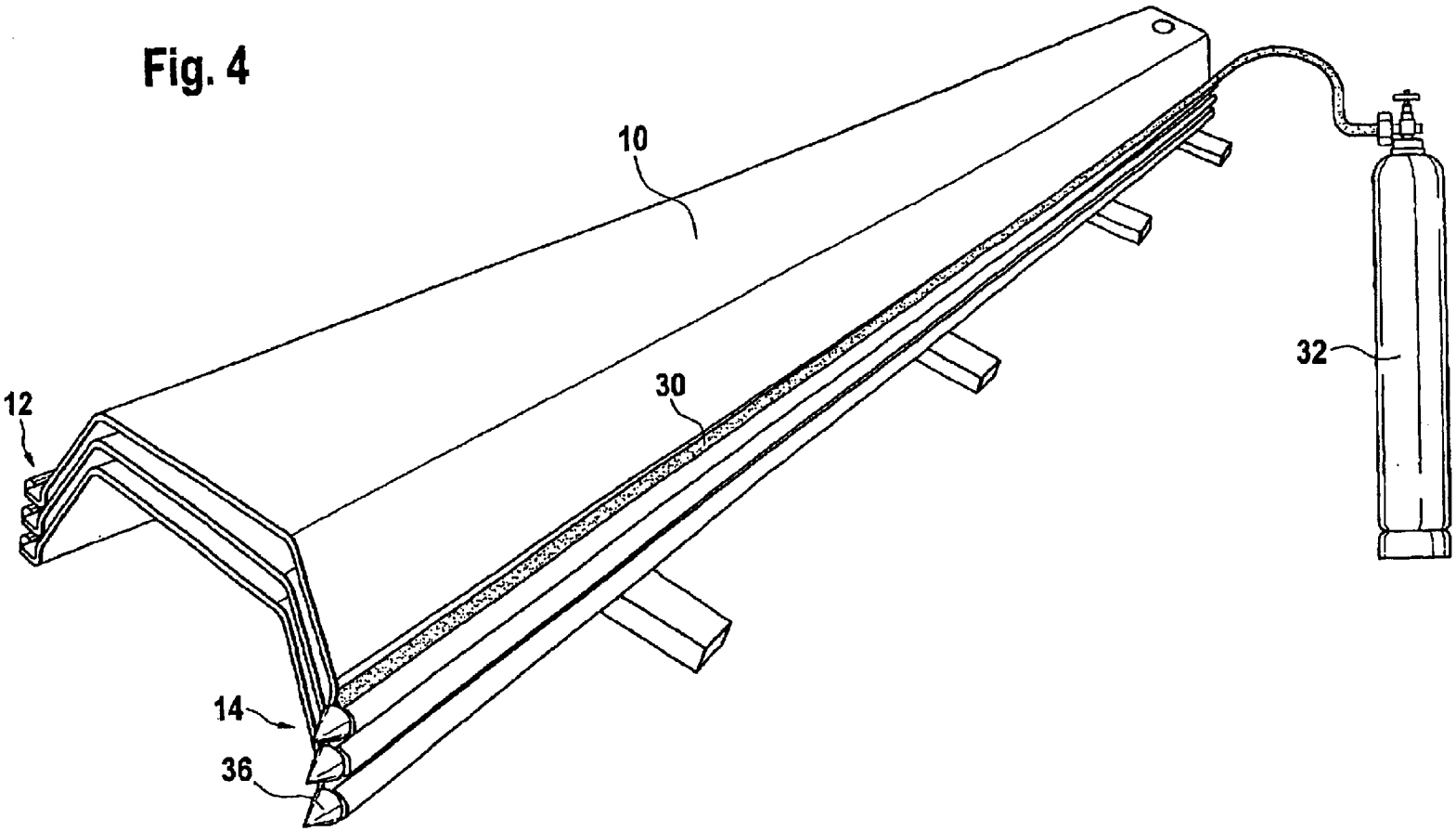
FIG. 4: is a perspective view of a sheet pile in which an obturating device is being inserted.
Figure 5:
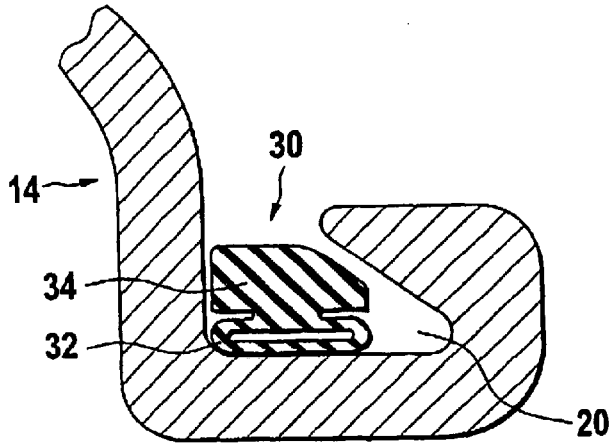
FIG. 5: is a section through a deflated obturating device inside a sheet pile interlock.
Figure 6:
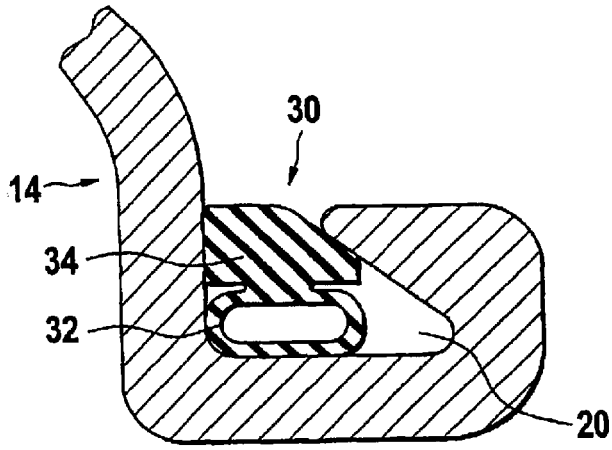
FIG. 6: is a section through an inflated obturating device inside a sheet pile interlock.
Figure 7:
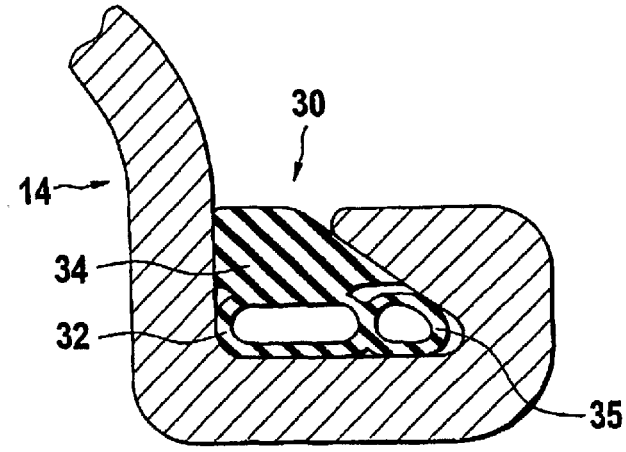
FIG. 7: is a section through an inflated obturating device with flexible tube inside a sheet pile interlock.

FIG. 4 shows an obturating device 30 being inserted in the leading sheet pile interlock 14 and inflated by compressed air means 32. The obturating device 30 is described in more detail by referring to FIGS. 5 and 6, in which the obturating device 30 is arranged in an interlock chamber 20 of a leading sheet pile interlock 14. The obturating device 30 comprises an inflatable tube 32 and a wedge shaped obturating block 34. FIGS. 5 and 6 show the inflatable tube 32 in its deflated and inflated state respectively. When the inflatable tube 32 is inflated, the obturating block 34 is firmly pressed in the longitudinal opening, which gives access to the interlock chamber 20. In other words, it blocks off this longitudinal opening of the interlock chamber 20, thereby preventing ground material from entering into the interlock chamber 20 through this opening. FIG. 7 shows an obturating device 30 having a flexible tube 35 running alongside the inflatable tube 32. The flexible tube 35 has an open front end and is used to insert sand into the interlock chamber 20 when the obturating device 30 is being removed from the interlock chamber 20. The longitudinal opening of the interlock chamber 20 is thereby blocked off, whence preventing ground material from entering into the interlock chamber 20 through this opening.

It will be noted that the preferred obturating device 30 shown in FIGS. 5 and 6 and in FIG. 7 is a semi-rigid rubber piece. It may include synthetic or metallic reinforcement fibres or fabrics, which increase its tensile strength. Its surfaces coming into contact with the walls of the sheet pile interlock may receive a friction reducing coating.

Figure 8:
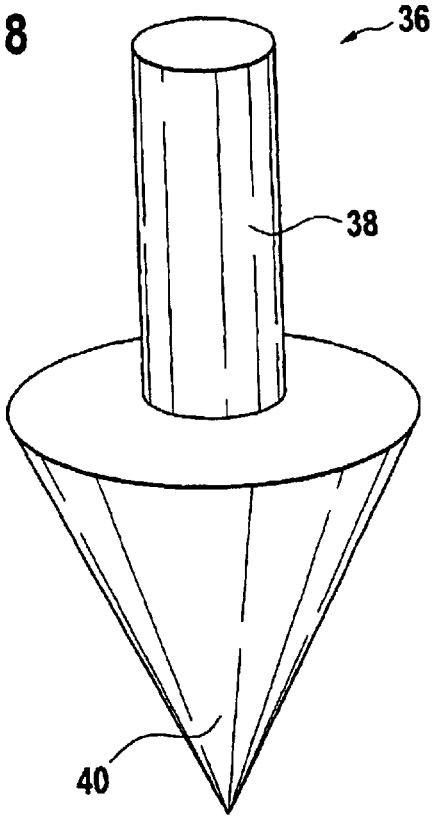
FIG. 8: is a perspective view of a front end obturator.
Figure 9:
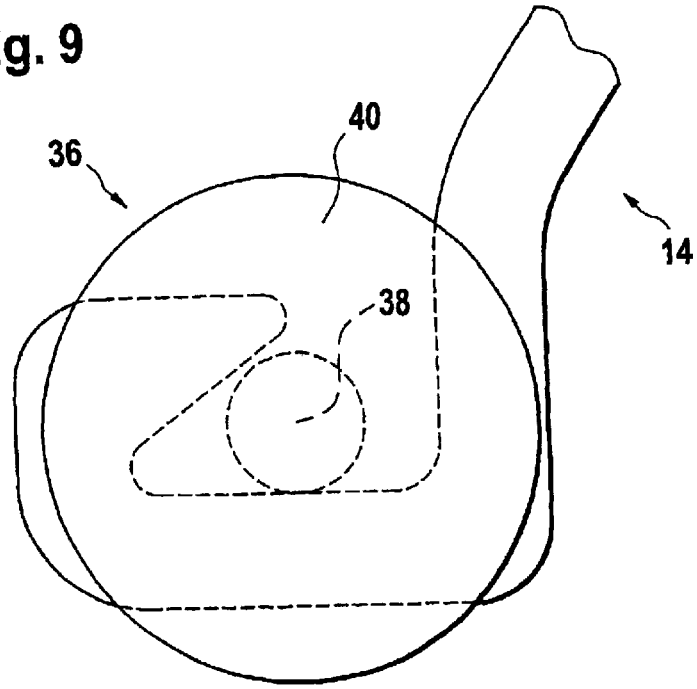
FIG. 9: is a schematic underneath view of the front end obturator of FIG. 8 inserted in a sheet pile interlock.

In order to protect the interlock chamber 20 from soil being pushed in axially from below as the sheet pile 10 is being driven, a front end obturator 36 is inserted in the bottom end of the interlock chamber 20. This front end obturator 36, which is shown in FIGS. 8 and 9, has a cylindrical body 38 and a conical head 40.

Before the second sheet pile 10' is interlocked with the first sheet pile 10 and driven into the ground, a short cleaning piece 42 is engaged in the leading sheet pile interlock 14 of the first sheet pile 10 for removing any ground material from the inner walls of the leading sheet pile interlock 14. The short cleaning piece 42 shown in FIG. 1 wraps the outer walls of the leading sheet pile interlock 14 and has an acute front end 44. Consequently, when it is pushed down along the leading sheet pile interlock 14 by the trailing sheet pile interlock 12' of the second sheet pile 10', it effectively removes any ground material from the outer walls of the leading sheet pile interlock 14.

What is claimed is:

1. A method for building a sheet pile wall, comprising the steps of:

providing a first sheet pile, said first sheet pile having a leading sheet pile interlock with an interlock chamber;

driving said first sheet pile into the ground while protecting said interlock chamber from ground material;

providing a second sheet pile, said second sheet pile having a trailing sheet pile interlock with an interlock head;

coating a fixing agent as a surface layer on an inside and an outside of said interlock head of said trailing sheet pile interlock;

engaging said coated interlock head of said trailing sheet pile interlock in said interlock chamber of said leading sheet pile interlock; and driving said second sheet pile into the ground, wherein said trailing sheet pile interlock interlocks with said leading sheet pile interlock.

2. The method according to claim 1, using a spreader to apply said surface layer of fixing agent onto said interlock head of said trailing sheet pile interlock.

3. The method according to claim 2, wherein a spreader chamber of said spreader engages said interlock head of said trailing sheet pile interlock, said spreader chamber having a slightly bigger cross-section than said interlock head of said trailing sheet pile interlock.

4. The method according to claim 3, using an injection nozzle to inject said fixing agent into said spreader chamber through an injection opening arranged in said spreader.

5. The method according to claim 1, wherein a longitudinal opening gives access to said interlock chamber in said leading sheet pile interlock and the step of protecting said interlock chamber from ground material comprises:

a) inserting an obturating device into said interlock chamber, said obturating device comprising an inflatable tube;

b) inflating said inflatable tube so that said obturating device closes said longitudinal opening giving access to said interlock chamber;

c) driving said sheet pile into the ground, wherein said obturating device prevents ground material from penetrating through said longitudinal opening into said interlock chamber;

d) deflating said inflatable tube; and e) withdrawing said obturating device from said interlock chamber.

6. The method according to claim 5, wherein said obturating device comprises an obturating block, and inflation of said inflatable tube pushes said obturating block into the longitudinal opening of said interlock chamber.

7. The method according to claim 5, said obturating device further comprises a flexible tube alongside said inflatable tube, and said interlock chamber is filled with sand through said flexible tube while withdrawing said obturating device from said interlock chamber.

8. The method according to claim 5, further comprising.

inserting a front end obturator in the bottom end of said interlock chamber of said leading sheet pile interlock before driving said first sheet pile into the ground.

9. The method according to claim 5, further comprising:

inserting a cleaning piece into said leading sheet pile interlock of said first sheet pile before interlocking it with said trailing sheet pile interlock of said second sheet pile.

10. The method according to claim 1, wherein said fixing agent is an adhesive or cement.

* * * * *